US006977015B2

(12) United States Patent
Hardwicke et al.

(10) Patent No.: US 6,977,015 B2
(45) Date of Patent: Dec. 20, 2005

(54) APPARATUS AND METHOD FOR CLEANING INTERNAL CHANNELS OF AN ARTICLE

(75) Inventors: Canan U. Hardwicke, Niskayuna, NY (US); Michael F. X. Gigliotti, Scotia, NY (US); John B. Deaton, Jr., Schenectady, NY (US); Paul L. Dupree, Scotia, NY (US); Robert S. Gilmore, Charlton, NY (US)

(73) Assignee: General Electric Company, Niskayuna, NY (US)

( * ) Notice: Subject to any disclaimer, the term of this patent is extended or adjusted under 35 U.S.C. 154(b) by 478 days.

(21) Appl. No.: 10/063,987

(22) Filed: May 31, 2002

(65) Prior Publication Data

US 2003/0221701 A1 Dec. 4, 2003

(51) Int. Cl.[7] ..... B08B 9/00; B08B 9/032

(52) U.S. Cl. ..... 134/1; 134/22.18; 134/169 R; 134/184

(58) Field of Search ..... 134/1, 22.1, 22.11, 134/22.18, 22.12, 18, 169 A, 169 R, 184

(56) References Cited

U.S. PATENT DOCUMENTS 4,595,419 A * 6/1986 Patenaude ..... 134/1
5,339,845 A * 8/1994 Huddas ..... 134/169 A
5,464,479 A * 11/1995 Kenton et al. ..... 134/1
5,490,882 A * 2/1996 Sachs et al. ..... 134/1
5,529,635 A * 6/1996 Odell ..... 134/1
5,679,174 A * 10/1997 Buongiorno ..... 134/22.18
5,707,453 A 1/1998 Shurman et al.
5,985,038 A 11/1999 Dawson
6,210,488 B1 * 4/2001 Bruce ..... 134/1
6,572,709 B1 * 6/2003 Kaneda et al. ..... 134/1
6,616,771 B2 * 9/2003 Osborne et al. ..... 134/18
6,663,718 B1 * 12/2003 Mush ..... 134/1

* cited by examiner

*Primary Examiner*—Alexander Markoff
(74) *Attorney, Agent, or Firm*—Paul J. DiConza; William E. Powell, III

(57) ABSTRACT

A method and apparatus for cleaning internal channels in an article are presented, with the method comprising providing an article that comprises at least one internal channel. The at least one internal channel comprises at least one inlet port and at least one outlet port. The method further comprises providing a cleaning apparatus, and this cleaning apparatus comprises a cleaning fluid, a reservoir containing the cleaning fluid, a transmitter of vibrational energy projecting into the reservoir the transmitter comprising a transmitter tip and a source of vibrational energy coupled to the transmitter, with the vibrational energy comprising a frequency and a wavelength. The reservoir of the provided apparatus comprises an interface adapted to accommodate attachment of the reservoir to the article, and this interface comprises an orifice to allow fluid communication between the reservoir and the at least one internal channel of the article. The method further comprises attaching the article to the apparatus at the interface.

38 Claims, 2 Drawing Sheets

APPARATUS AND METHOD FOR CLEANING INTERNAL CHANNELS OF AN ARTICLE

BACKGROUND OF INVENTION

This invention relates to methods for cleaning articles. More particularly, this invention relates to methods for cleaning debris from internal channels of articles such as, for example, gas turbine engine components. This invention also relates to apparatus used to clean the internal channels of such articles.

In a typical gas turbine engine, compressed air is mixed with fuel in a combustor and ignited, generating a flow of hot combustion gases through one or more turbine stages that extract energy from the gas, producing output power. Each turbine stage includes a stator nozzle having vanes that direct the combustion gases against a corresponding row of turbine blades extending radially outwardly from a supporting rotor disk. The vanes and blades are subject to substantial heat load, and, because the efficiency of a gas turbine engine is related to gas temperature, the continuous demand for efficiency translates to a demand for airfoils that are capable of withstanding higher temperatures for longer service times.

Gas turbine airfoils on such components as vanes and blades are usually made of superalloys and often employ internal cooling channels to avoid overheating the component to temperatures beyond the capabilities of these materials. The term "superalloy" is usually intended to embrace iron-, cobalt-, or nickel-based alloys, which include one or more other elements including such non-limiting examples as aluminum, tungsten, molybdenum, titanium, and iron. The internal air-cooling of turbine airfoils is often accomplished via a complex cooling scheme in which cooling air flows through channels, often serpentine in shape, within the airfoil ("internal channels" or "internal cooling channels") and is then discharged through a configuration of small cooling holes at the airfoil surface. Convection cooling occurs within the airfoil from heat transfer to the cooling air as it flows through the internal cooling channels.

A considerable amount of cooling air is often required to sufficiently lower the surface temperature of an airfoil. This cooling air generally contains particulate matter, such as dust, sand, mineral deposits, and other foreign matter entrained in the air taken in to cool the engine. The particles can adhere to the walls of the internal cooling channels and accumulate to a point where the cooling air flow through the channel is partially or completely restricted. The resulting restrictions in cooling airflow promotes higher component operating temperatures and the accompanying risk of performance problems, including severe damage to the component due to overheating.

In order to extend the life of costly gas turbine engine components, debris accumulations in the internal cooling channels are periodically removed by any of various cleaning processes, including autoclave processes wherein the component is exposed to high temperature and high pressure fluid for a period of time; and ultrasonic cleaning, wherein the component is immersed into a cleaning fluid and ultrasonically agitated. Both of these methods are effective in cleaning simple components, but are not nearly as effective for cleaning components with complicated internal passages, for example, as found in a gas turbine blade. Effective cleaning processes remove substantially all of the debris accumulated within the internal channels; at the same time, cleaning processes strive for efficiency, due to the large numbers of components, such as airfoils, that must be cleaned when overhauling even a single gas turbine engine. Therefore, there is a need to provide an effective methods and apparatus for efficiently cleaning gas turbine components, especially those with complicated geometry, as in the exemplary case of a gas turbine blade with internal cooling passages.

SUMMARY OF INVENTION

Embodiments of the present invention are provided to address these and other needs. One embodiment is a method for cleaning internal channels in an article. The method comprises providing an article that comprises at least one internal channel. The at least one internal channel comprises at least one inlet port and at least one outlet port. The method further comprises providing a cleaning apparatus, and this cleaning apparatus comprises a cleaning fluid, a reservoir containing the cleaning fluid, a transmitter of vibrational energy projecting into the reservoir, the transmitter comprising a transmitter tip, and a source of vibrational energy coupled to the transmitter, with the vibrational energy comprising a frequency and a wavelength. The reservoir of the provided apparatus comprises an interface adapted to accommodate attachment of the reservoir to the article, and this interface comprises an orifice to allow fluid communication between the reservoir and the at least one internal channel of the article. The method further comprises attaching the article to the apparatus at the interface.

Another embodiment is the cleaning apparatus described above for use in the method of the present invention. The apparatus comprises a cleaning fluid; a reservoir containing the cleaning fluid, the reservoir comprising an interface adapted to accommodate attachment of the reservoir to an article comprising at least one internal channel, the at least one channel comprising at least one inlet port and at least one exit port, the interface comprising an orifice to allow fluid communication between the reservoir and the at least one internal channel of the article; a transmitter of vibrational energy adjustably projecting into the reservoir; and a source of vibrational energy coupled to the transmitter, the vibrational energy comprising a frequency and a wavelength.

BRIEF DESCRIPTION OF DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
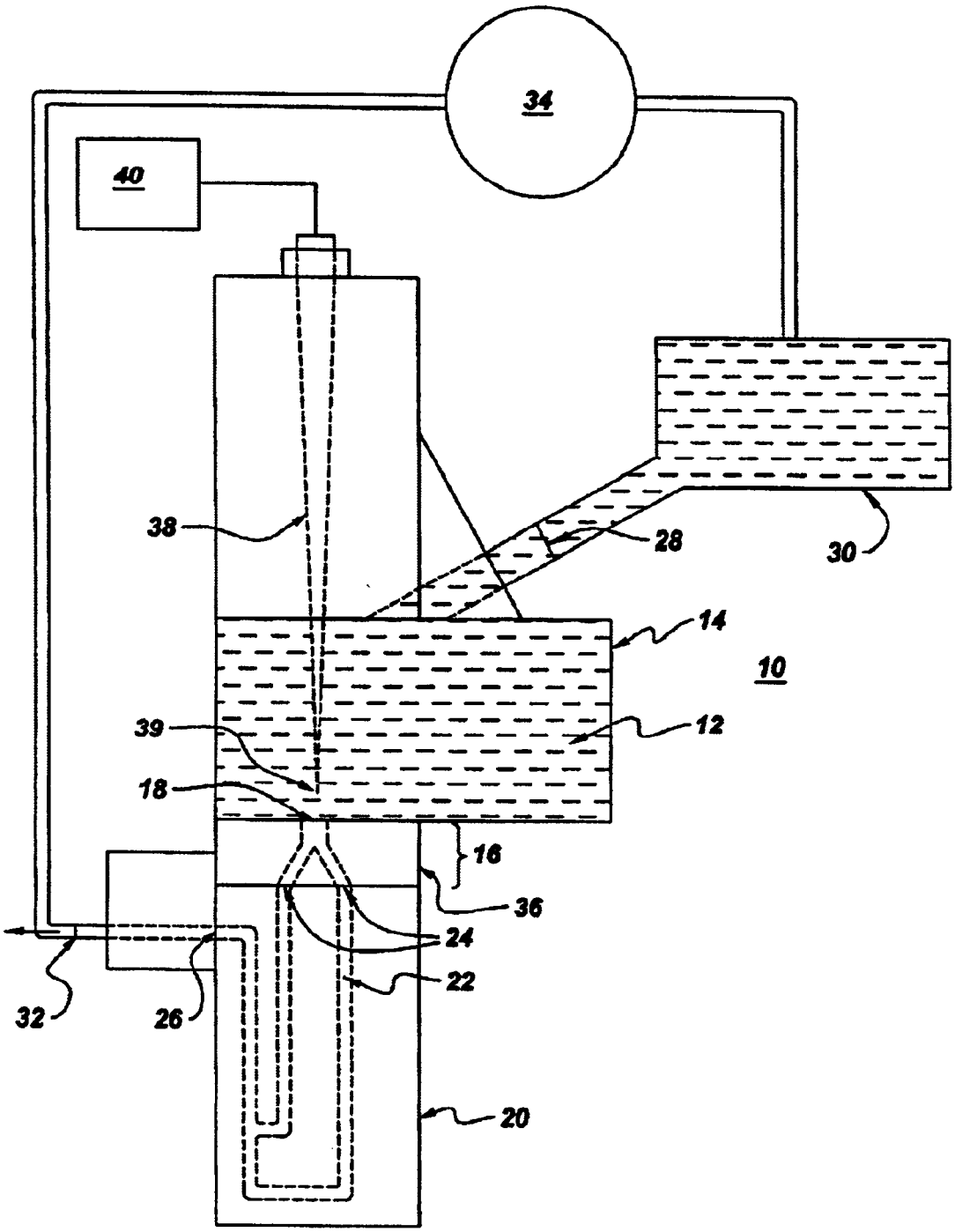
FIG. 1 is a schematic representation of an example of the apparatus of the present invention.

In part, the method of the present invention comprises providing an article. As the non-limiting example depicted in FIG. 1 illustrates, the article 20 comprises at least one internal channel 22, and the at least one internal channel 22 comprises at least one inlet port 24 and at least one outlet port 26. In certain embodiments, providing the article 20 comprises providing a gas turbine engine component, for example, a gas turbine blade.

The method of the present invention further comprises providing a cleaning apparatus 10, such as, for example, the cleaning apparatus 10 depicted in FIG. 1. The apparatus 10 comprises a cleaning fluid 12. Any fluid medium type, including liquids and gasses, for example, is suitable for use in the apparatus 10, but often the fluid 12 comprises a liquid. In certain embodiments, the fluid 12 comprises water. In other embodiments, the fluid 12 comprises at least one of an acid and a base, in order to provide enhanced cleaning through chemical interaction between the fluid 12 and the foreign material to be removed. In still further embodiments, the fluid 12 comprises a surfactant, which enhances wetting of the fluid 12 to any internal surfaces and the surface of the foreign material, again to provide enhanced cleaning. In certain embodiments, the fluid 12 comprises abrasive solid particles, which provide enhanced cleaning by mechanical interaction with the foreign material.

Cleaning apparatus 10 further comprises a reservoir 14 containing the cleaning fluid 12. Reservoir 14 comprises an interface 16 adapted to accommodate attachment of reservoir 14 to article 20; that is, interface 16 is shaped to conform to article 20 to allow for a fluid-tight connection to be achieved between reservoir 14 and article 20. Interface 16 comprises an orifice to allow fluid communication between reservoir 14 and the at least one internal channel 22 of article 20. In some embodiments, reservoir 14 further comprises a cleaning fluid inlet 28 connected to a source of cleaning fluid 30, and a cleaning fluid outlet 32 to expel excess cleaning fluid 12, and the method of the present invention in these embodiments further comprises flowing the cleaning fluid 12 from fluid source 30 through the reservoir 14 and the at least one internal channel 22 of article 20, and out through cleaning fluid outlet 32. Flowing the fluid 12 enhances the cleaning power of apparatus 10 by allowing for mechanical interaction with any foreign material, as well as by constantly providing fresh cleaning fluid 12 to the areas of article 20 to be cleaned. To exploit this enhancement further, in certain embodiments providing the cleaning apparatus 10 further comprises providing a fluid circulator 34 coupled to cleaning fluid outlet 32 and source of cleaning fluid 30, and flowing comprises circulating the cleaning fluid 12. Fluid circulator 34, for example, a pump, circulates fluid 12 from the fluid outlet 32 back to fluid source 30, and the returning fluid 12 is filtered, if necessary, to remove foreign materials. In particular embodiments, interface 16 further comprises a manifold 36 in fluid communication with at least one internal channel 22 of article 20, and flowing the cleaning fluid 12 further comprises flowing the fluid 12 through manifold 36 to direct the fluid 12 into the at least one inlet port 24 of the at least one internal channel 22 and out of the at least one exit port of the at least one internal channel 22. The use of manifold 36 is particularly advantageous where article 20 comprises a plurality of entry and exit ports.

Reservoir 14, in some embodiments, comprises a material that is substantially inert to the cleaning fluid, meaning that the cleaning fluid does not react chemically with the material comprising reservoir 14 to a point where the cleaning properties of the fluid or the dimensions of reservoir 14 are significantly altered. In particular embodiments, the material comprising reservoir 14 is polytetrafluoroethylene.

Cleaning apparatus 10 further comprises a transmitter 38 of vibrational energy projecting into the reservoir 14, the transmitter 38 comprising a transmitter tip 39; and a source of vibrational energy 40 coupled to the transmitter 38. In some embodiments, transmitter 38 comprises a probe, such as, for example, a metal probe commonly used in the art to transmit sonic and ultrasonic energy. In other embodiments, transmitter 38 comprises a horn, such as, for example, a metal horn also used in the art to transmit sonic and ultrasonic energy. The vibrational energy transmitted comprises a frequency and a wavelength. In certain embodiments, source of vibrational energy 40 is tunable, meaning that source of vibrational energy 40 has the capability to provide energy of a frequency that is selected from a range of available frequencies.

The method of the present invention further comprises attaching article 20 to apparatus 10 at interface 16. Those skilled in the art will appreciate that attaching article 20 to apparatus 10 is accomplished using any of a variety of suitable methods, including clamping apparatus 10 to article 20; applying fasteners such as screws or bolts to attach article 20 and apparatus 10; using a threaded junction to attach article 20 and apparatus 10; and the like.

In some embodiments, the method of the present invention further comprises transmitting vibrational energy from source of vibrational energy through transmitter 38 to article 20. The use of vibrational energy, such as sonic and ultrasonic energy, enhances the cleaning capability of apparatus 10 by fracturing and loosening foreign material from the at least one internal channel 22 of article 20. In certain embodiments, transmitting comprises transmitting vibrational energy wherein the frequency of the vibrational energy is at least about 100 Hz. In particular embodiments, the frequency is at least about 10 kHz.

Figure 2:
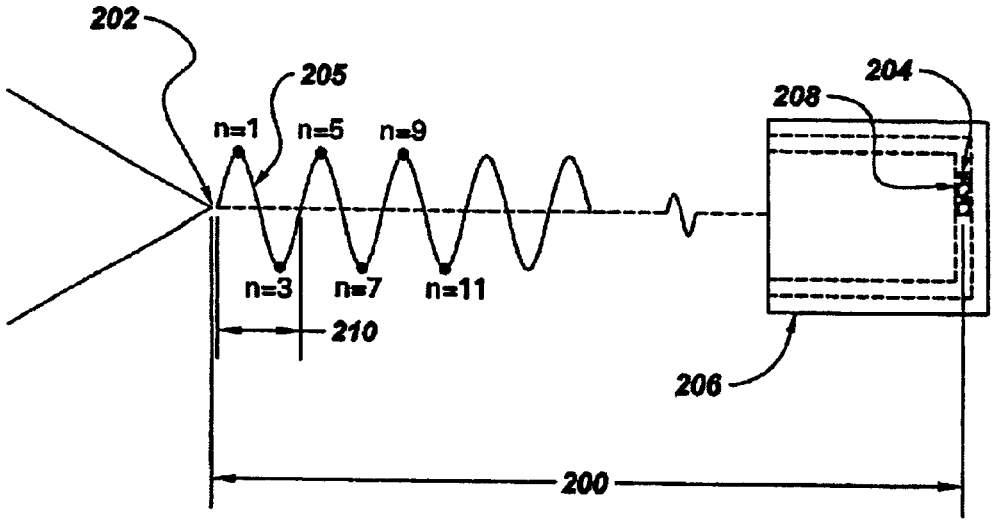
FIG. 2 is a schematic representation of vibrational energy emanating from the apparatus of the present invention.

The present inventors have found that the cleaning enhancement offered by the use of vibrational energy is optimized in particular embodiments, as depicted in FIG. 2, by adjusting at least one of an energy transmission distance 200 extending from transmitter tip 202 to a desired reference point 204, and the frequency of the vibrational energy 205. Reference point 204 is often determined to be a region within article 206 that contains a concentration of debris 208. The determination is done using any of various methods, including using non-destructive evaluation to determine regions of debris concentration 208. Those skilled in the art will appreciate that areas of debris concentration 208 within an article of a particular design often do not vary significantly among individual articles, and so after making a preliminary determination of the most likely region or regions of debris concentration 208, based upon a number of individual specimens of a given article design, a general determination of the reference point 204 applicable to the article design can be made and used thereafter without making an actual determination for each individual article.

The adjustment described above is made according to the equation $d=n\lambda/4$, where d is energy transmission distance 200, $\lambda$ is the wavelength 210 of the vibrational energy 205, and n=1,3,5,7,9, . . . . As illustrated in FIG. 2, adjusting at least one of the energy transmission distance 200 and the frequency as specified allows for vibrational energy 205 of maximum absolute displacement to impinge article 206 in the region corresponding to reference point 204, thereby providing an optimized amount of vibrational displacement to the region of debris concentration 208, which results in optimized cleaning efficiency.

In order to further exploit the advantages of the method of the present invention, specific embodiments of the present invention include a method for cleaning internal channels of a gas turbine engine component, comprising: providing a gas turbine engine component, the component comprising at least one internal channel, the at least one internal channel comprising at least one inlet port and at least one exit port; providing a cleaning apparatus, the apparatus comprising a. a cleaning fluid comprising a liquid; b. a reservoir containing the fluid, the reservoir comprising i. an interface adapted to accommodate attachment of the reservoir to the gas turbine engine component, the interface comprising a manifold adapted to allow fluid communication between the reservoir and the at least one internal channel of the engine component, ii. a cleaning fluid inlet connected to a source of the cleaning fluid, and iii. a cleaning fluid outlet, c. a transmitter of vibrational energy projecting into the reservoir, the transmitter comprising a transmitter tip; and d. a source of vibrational energy coupled to the transmitter, the vibrational energy comprising a frequency and a wavelength; attaching the engine component to the apparatus at the interface; transmitting vibrational energy from the source of vibrational energy through the transmitter to the article; adjusting an energy transmission distance extending from the transmitter tip to a desired reference point on the article according to the equation $d=n\lambda/4$, where d is the energy transmission distance, $\lambda$ is the wavelength, and n=1,3,5,7,9, . . . and flowing the cleaning fluid from the fluid source through the reservoir and the at least one internal channel of the article, and out through the cleaning fluid outlet.

The combination of flowing cleaning fluid through the internal passages of the article with agitation of the foreign material by controlled use of vibrational energy provides significant capability to clean articles with complicated internal channels, such as turbine blades, without the need to immerse the articles in a tank of fluid. The amount of time needed to clean the passages of an article will depend on a number of factors, such as the design of the article and the materials from which the article is fabricated, amount and type of debris in the channels, type of cleaning fluid used, and the level of ultrasonic power applied to the article, for example. Generally the cleaning process is carried out for a time in the range from about 10 minutes to about 10 hours, such as a time in the range from about 10 minutes to about 1 hour; a measurement, such as by x-ray imaging or other non-destructive evaluation technique, or by measuring air flow capability of the internal channels, can be used to determine the point at which the internal passages are satisfactorily clear of debris.

Another embodiment of the present invention is the apparatus described above. To take advantage of the many desirable features presented above, specific embodiments include an apparatus for cleaning internal channels of a gas turbine engine component, the apparatus comprising: a cleaning fluid comprising water; a reservoir containing the water, the reservoir comprising an interface adapted to accommodate attachment of the reservoir to a gas turbine engine component comprising at least one internal channel, the interface comprising an orifice to allow fluid communication between the reservoir and the at least one internal channel of the engine component, a cleaning fluid inlet connected to a source of the cleaning fluid, and a cleaning fluid outlet to expel excess cleaning fluid; a fluid circulator coupled to the source of the cleaning fluid; a transmitter of vibrational energy projecting into the reservoir, the transmitter comprising a transmitter tip; and a source of vibrational energy coupled to the transmitter, the vibrational energy comprising a frequency and a wavelength; wherein the transmitter is adjustably projecting into the reservoir to define an energy transmission distance, the energy transmission distance extending from the transmitter tip to a desired reference point on the article, and the energy transmission distance is related to the wavelength of the vibrational energy through the equation $d=n\lambda/4$; where d is the energy transmission distance, $\lambda$ is the wavelength, and n=1,3,5,7, 9, . . . .

While various embodiments are described herein, it will be appreciated from the specification that various combinations of elements, variations, equivalents, or improvements therein may be made by those skilled in the art, and are still within the scope of the invention as defined in the appended claims.

What is claimed is:

1. A method for cleaning internal channels in an article, said method comprising:

providing an article, said article comprising at least one internal channel comprising at least one inlet port and at least one outlet port;

providing a cleaning apparatus, said apparatus comprising a cleaning fluid, a reservoir containing said cleaning fluid, said reservoir comprising an interface shaped to allow a fluid-tight connection between said reservoir and said article, said interface comprising an orifice to allow fluid communication between said reservoir and said at least one internal channel of said article, said reservoir further comprising a cleaning fluid inlet connected to a source of said cleaning fluid, and a cleaning fluid outlet to expel excess cleaning fluid;

a transmitter of vibrational energy projecting into said reservoir, said transmitter comprising a transmitter tip, and a source of vibrational energy coupled to said transmitter, said vibrational energy comprising a frequency and a wavelength;

attaching said article to said apparatus at said interface; and flowing said cleaning fluid from said fluid source through said reservoir and said at least one internal channel of said article, and out through said cleaning fluid outlet; and transmitting vibrational energy from said source of vibrational energy through said transmitter to said article.

2. The method of claim 1, wherein transmitting comprises transmitting vibrational energy wherein said frequency is at least about 100 Hz.

3. The method of claim 2, wherein said frequency is at least about 10 kHz.

4. The method of claim 1, wherein said source of vibrational energy is tunable.

5. The method of claim 1, further comprising adjusting at least one of a. an energy transmission distance extending from said transmitter tip to a desired reference point on said article, and b. said frequency of said vibrational energy, according to the equation $d=n\lambda 4$, where d is said energy transmission distance, $\lambda$ is said wavelength, and n is a number having a value selected from the group consisting of the odd integers.

6. The method of claim 1, wherein said interface further comprises a manifold in fluid communication with said at least one internal channel of said article, and wherein flowing further comprises flowing said cleaning fluid through said manifold to direct said fluid into said at least one inlet port of said at least one internal channel and out of said at least one exit port of said at least one internal channel.

7. The method of claim 1, wherein providing said article comprises providing a gas turbine engine component, said component comprising at least one internal channel, said at least one internal channel comprising at least one inlet port and at least one outlet port.

8. The method of claim 7, wherein said component comprises a turbine blade.

9. The method of claim 1, wherein said cleaning fluid comprises a liquid.

10. The method of claim 9, wherein said fluid comprises water.

11. The method of claim 9, wherein said fluid further comprises a surfactant.

12. The method of claim 9, wherein said liquid comprises at least one of an acid and a base.

13. The method of claim 1, wherein said fluid further comprises abrasive solid particles.

14. The method of claim 1, wherein providing said cleaning apparatus further comprises providing a fluid circulator coupled to said cleaning fluid outlet and said source of cleaning fluid, and wherein flowing comprises circulating said cleaning fluid.

15. The method of claim 1, wherein said transmitter of said apparatus comprises a probe.

16. The method of claim 1, wherein said transmitter of said apparatus comprises a horn.

17. The method of claim 1, wherein said reservoir of said apparatus comprises a material that is substantially inert to said cleaning fluid.

18. The method of claim 17, wherein said material comprises polytetrafluoroethylene.

19. A method for cleaning internal channels of a gas turbine engine component, comprising:

providing a gas turbine engine component, said component comprising at least one internal channel, said at least one internal channel comprising at least one inlet port and at least one exit port;

providing a cleaning apparatus, said apparatus comprising a. a cleaning fluid comprising a liquid;

b. a reservoir containing said fluid, said reservoir comprising i. an interface shaped to allow a fluid-tight connection between said reservoir and said gas turbine engine component, said interface comprising a manifold adapted to allow fluid communication between said reservoir and said at least one internal channel of said engine component, ii. a cleaning fluid inlet connected to a source of said cleaning fluid, and iii. a cleaning fluid outlet, c. a transmitter of vibrational energy projecting into said reservoir, said transmitter comprising a transmitter tip; and d. a source of vibrational energy coupled to said transmitter, said vibrational energy comprising a frequency and a wavelength;

attaching said engine component to said apparatus at said interface;

transmitting vibrational energy from said source of vibrational energy through said transmitter to said article;

adjusting an energy transmission distance extending from said transmitter tip to a desired reference point on said article according to the equation $d=n\lambda 4$, where d is said energy transmission distance, $\lambda$ is said wavelength, and n is a number having a value selected from the group consisting of the odd integers; and flowing said cleaning fluid from said fluid source through said reservoir and said at least one internal channel of said article, and out through said cleaning fluid outlet.

20. An apparatus for cleaning internal channels in an article, said apparatus comprising:

a cleaning fluid;

a reservoir containing said cleaning fluid, said reservoir comprising an interface shaped to allow a fluid-tight connection between said reservoir and an article comprising at least one internal channel, said at least one channel comprising at least one inlet port and at least one exit port, said interface comprising an orifice to allow fluid communication between said reservoir and said at least one internal channel of said article, said reservoir further comprising a cleaning fluid inlet connected to a source of said cleaning fluid and a cleaning fluid outlet;

a fluid circulator coupled to said source of said cleaning fluid;

a transmitter of vibrational energy adjustably projecting into said reservoir;

a source of vibrational energy coupled to said transmitter, said vibrational energy comprising a frequency and a wavelength.

21. The apparatus of claim 20, wherein said fluid comprises a liquid.

22. The apparatus of claim 21, wherein said fluid comprises water.

23. The apparatus of claim 21, wherein said fluid further comprises a surfactant.

24. The apparatus of claim 21, wherein said liquid comprises at least one of an acid and abase.

25. The apparatus of claim 21, wherein said fluid further comprises abrasive solid particles.

26. The apparatus of claim 20, further comprising a fluid circulator coupled to said source of said cleaning fluid.

27. The apparatus of claim 26, wherein said circulator comprises a pump.

28. The apparatus of claim 20, wherein said interface further comprises a manifold to direct said fluid into said at least one inlet port of said at least one internal channel and out of said at least one exit port of said at least one internal channel.

29. The apparatus of claim 20, wherein said frequency is at least about 100 Hz.

30. The apparatus of claim 29, wherein said frequency is at least 10 kHz.

31. The apparatus of claim 20, wherein said source of vibrational energy is tunable.

32. The apparatus of claim 20, wherein said transmitter comprises a probe.

33. The apparatus of claim 20, wherein said transmitter comprises a horn.

34. The apparatus of claim 20, wherein said cavity comprises a material that is substantially inert to said cleaning fluid.

35. The apparatus of claim 34, wherein said material is polytetrafluoroethylene.

36. The apparatus of claim 20, wherein said article comprises at least one gas turbine engine component, said at least one component comprising at least one internal channel.

37. The apparatus of claim 36, wherein said at least one gas turbine engine component is a turbine blade.

38. An apparatus for cleaning internal channels of a gas turbine engine component, said apparatus comprising:

a cleaning fluid comprising water;

a reservoir containing said water, said reservoir comprising an interface shaped to allow a fluid-tight connection between said reservoir and a gas turbine engine component comprising at least one internal channel, said interface comprising an orifice to allow fluid communication between said reservoir and said at least one internal channel of said engine component, a cleaning fluid inlet connected to a source of said cleaning fluid, and a cleaning fluid outlet to expel excess cleaning fluid;

a fluid circulator coupled to said source of said cleaning fluid;

a transmitter of vibrational energy projecting into said reservoir, said transmitter comprising a transmitter tip; and a source of vibrational energy coupled to said transmitter, said vibrational energy comprising a frequency and a wavelength;

wherein said transmitter is adjustably projecting into said reservoir to define an energy transmission distance, said energy transmission distance extending from said transmitter tip to a desired reference point on said article, and said energy transmission distance is related to said wavelength of said vibrational energy through the equation $$d=n\lambda/4;$$

where d is said energy transmission distance, $\lambda$ is said wavelength, and n is a number having a value selected from the group consisting of the odd integers.

* * * * *